United States Patent [19]

Pascoe

[11] 4,392,626

[45] Jul. 12, 1983

[54] VITAL PROTECTION ARRANGEMENT FOR RAILROAD TRACK CIRCUITS

[75] Inventor: Robert D. Pascoe, Upper St. Clair Township, Allegheny County, Pa.

[73] Assignee: American Standard Inc., Swissvale, Pa.

[21] Appl. No.: 301,619

[22] Filed: Sep. 14, 1981

[51] Int. Cl.[3] ..... B61L 21/06; B61L 25/00

[52] U.S. Cl. ..... 246/34 R; 246/34 CT; 246/122 R

[58] Field of Search ..... 246/34 R, 34 C, 34 A, 246/34 CT, 28 K, 41, 42, 61, 130, 72, 81, 34 R, 122 R

[56] References Cited

U.S. PATENT DOCUMENTS

| | | | |
|---|---|---|---|
| 2,884,516 | 4/1959 | Staples | 246/34 R |
| 3,986,691 | 10/1976 | Elrlich et al. | 246/34 R |
| 4,298,179 | 11/1981 | Gilcher | 246/34 R |

*Primary Examiner*—James J. Groody

*Attorney, Agent, or Firm*—A. G. Williamson, Jr.

[57] ABSTRACT

A tuned transformer element has its primary winding coupled, in series with a fuse of preselected rating, to the rails of the track circuit. A secondary winding supplies input energy to the track circuit receiver unit which detects occupancy conditions of the track section. A third winding is capacitor tuned to resonate with the primary winding at the track circuit frequency. Thus the transformer appears as a parallel resonant load of high impedance in multiple with the track receiver which then operates normally. At propulsion frequency, the impedance of the primary is small while the parallel capacitive reactance is large, so that the parallel network gives the transformer unit a low impedance at this frequency. If, due to unbalance in the rails, the propulsion current is large enough that its harmonics may energize the track circuit receiver to improperly register an unoccupied track section, the current in the primary winding exceeds the fuse rating and the primary circuit is opened to inhibit any track circuit receiver response.

6 Claims, 2 Drawing Figures

VITAL PROTECTION ARRANGEMENT FOR RAILROAD TRACK CIRCUITS

FIELD OF THE INVENTION

My invention pertains to a vital protection arrangement for railroad track circuits. More particularly, the invention relates to an arrangement using a parallel resonant unit for protecting alternating current track circuits against interference by harmonic frequencies from alternating current propulsion power flowing in the rails.

BACKGROUND OF THE INVENTION

In alternating current track circuits for electrified railroads using alternating current propulsion power, the track relay means on occasion may be subject to application of propulsion power at a high voltage level. This may be due to any one of several conditions, for example, the opening of an impedance bond connection or a broken rail in the section. Although the signaling and propulsion sources have different frequencies, with the propulsion power normally at the lower frequency, harmonics of the propulsion frequency may be at or near the frequency of the signaling current to which the filters and/or the track relay inputs are tuned. High voltage interference from the power source then can result in the track relay being energized to register an unoccupied track section even though a train may actually be occupying the corresponding section. Obviously, this is an unsafe, even dangerous condition and where occurrence is likely, some arrangement to protect against this fault condition is not only desirable but may be required.

Accordingly, an object of my invention is a coupling arrangement between an alternating current track circuit receiver and the rails in the section to vitally protect against high voltage surges or spikes induced into the rails.

Another object of the invention is a vital protection arrangement against interference in a railroad track circuit by harmonic frequency components of the propulsion currents.

A further object of the invention is a vital parallel resonant transformer apparatus used in coupling an alternating current track circuit receiver network to the section rails to inhibit activation of that receiver by currents having harmonic frequency components of the propulsion power.

A still further object of the invention is a vital parallel resonant transformer unit whose primary winding is coupled to the track rails, a secondary winding is connected to the track circuit receiver, and a third winding, capacitor tuned to the track circuit frequency, in combination with the primary prevents propulsion power interference with track circuit operation.

Yet another object of the invention is vital protection apparatus for an alternating current railroad track circuit which includes a transformer having a primary winding connected in series with a fuse having a preselected capacity and coupled to the rails through a track transformer, winding connected to the track circuit receiver input, and a third winding tuned by a capacitor to resonate with the primary at the track circuit frequency but presenting a low impedance to propulsion current so that high levels of this current will interrupt the track circuit receiver connections to the rails by opening the fuse.

Other objects, features, and advantages of the invention will become apparent from a following specification and appended claims when taken in connection with the accompanying drawings.

SUMMARY OF THE INVENTION

According to the invention, a principal part of the vital protection arrangement is a transformer with three windings. The primary winding, in series with a fuse of preselected capacity, is coupled to the rails of the track section or track circuit. A second winding, which is the principal secondary, is coupled to the track circuit receiver unit specifically shown herein as a phase selective unit of known composition and operation. A third winding of the transformer is tuned by a capacitor so as to resonate in combination with the primary winding at the frequency of the alternating track circuit source. This results in a transformer unit which has a high impedance at the track circuit frequency in parallel with the track circuit receiver and a lower impedance at the propulsion frequency. With normal levels of propulsion and track circuit currents, the unit functions to apply the received track circuit energy to the track receiver. Although the transformer presents a low impedance to the propulsion current, the capacity of the fuse is so selected that normal operations do not blow the fuse. Since the track circuit receiver, specifically a phase selective unit, is also tuned to the track circuit frequency, it is not affected by the propulsion current flowing in the primary of the tuned transformer element. If the propulsion current becomes very high due to an unbalanced condition in the track, its harmonic components may have an improper effect on the track circuit. That is, the track circuit receiver may respond to this false energy and pick up the track relay even with a train occupying the section. However, the propulsion current flowing through the transformer primary, which presents a low impedance at such frequency, will exceed the capacity of and blow the fuse to shut down the track circuit receiver and/or relay operation. Obviously, this inhibits any response by the track relay which would improperly register an unoccupied track condition.

BRIEF DESCRIPTION OF THE DRAWINGS

Before defining my invention in the appended claims, I will describe in more detail a parallel resonant unit embodying the invention and one typical application thereof as illustrated in the drawings, in which:

In each of the drawings, similar reference characters designate the same or similar parts of the apparatus.

DESCRIPTION OF THE ILLUSTRATED EMBODIMENT

Figure 1:
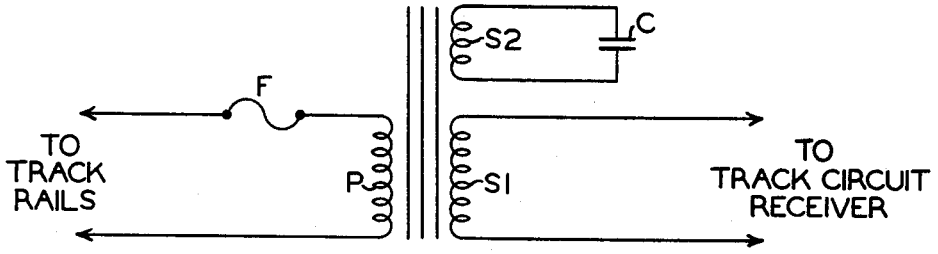
FIG. 1 is a schematic circuit sketch of a parallel resonant unit embodying the invention.

FIG. 1 shows schematically the circuit arrangement of a parallel resonant unit (PRU) which is a basic element of the track circuit protection arrangement of this invention. The transformer, which will be packaged in a unit PRU, has three windings, a primary winding P, a principal secondary winding S1, and another secondary or third winding S2, all wound on the same magnetic core. Winding P is connected in series with a fuse F and this series network is coupled across the rails of the corresponding track circuit. Fuse F is included within the unit package, that is, within the case or container holding all the elements. Secondary winding S1 is coupled to the track circuit receiver apparatus and/or track relay, as will be more fully discussed shortly. A capacitor C is connected across winding S2. The value of capacitor C is selected to form a resonant network with primary winding P at the signaling frequency, i.e., the track circuit source frequency. Capacitor C is also included in the unit packaging.

Figure 2:
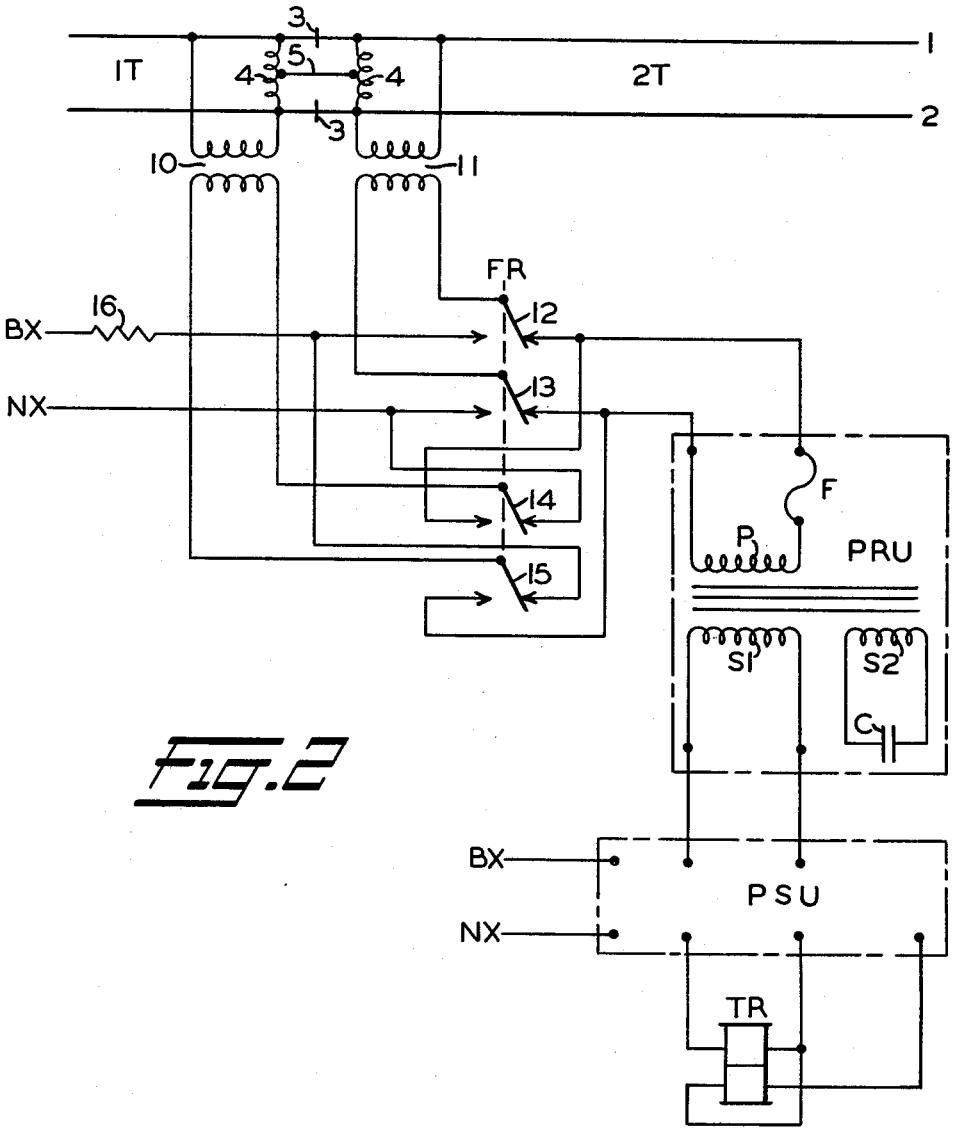
FIG. 2 schematically illustrates the use of the parallel resonant unit of FIG. 1 in a railroad track circuit installation.

Referring now to FIG. 2 in which is shown the application of unit PRU to provide propulsion current protection for alternating current track circuits in a stretch of railroad track. Across the top of this drawing figure is illustrated a portion of a railroad track, with the rails 1 and 2 shown conventionally. Insulated joints 3 divide this track into adjoining sections 1T and 2T with only a portion of each section actually shown. Since this is assumed to be a stretch of electrified railroad, the insulated joints are bypassed for propulsion current return by a circuit network including the two impedance bond windings 4 which are joined at the midpoint by a connection 5. As a specific example, this propulsion power may be alternating current having a frequency of 25 Hz. This is conventional circuitry for electrified railroads and is understood and thus not described in greater detail. The stretch of track is also provided with track circuits, one for each track section. These may be coded track circuits but such are not specifically shown for simplicity. The track circuits, of alternating current type, are supplied from a single source which, for example, may have a frequency of 100 or 200 Hz. Connections to this track circuit source, that is, the two terminals thereof, are designated in the drawing by the references BX and NX. Various connections to the same track circuit source are made at each wayside location such as shown in this drawing figure.

The wayside apparatus is coupled to the rails of the track sections 1T and 2T by track transformers 10 and 11, respectively. The track circuits are illustrated as being reversible in order to control train movements in either direction of traffic, with eastbound traffic moving to the right and westbound traffic to the left. Thus, at each end of a track section, the rail coupling through the track transformer to the wayside apparatus is switched between the source, that is, the transmitter, and the receiver apparatus. This is accomplished at the illustrated location in FIG. 2 by contacts of a traffic control device FR. These contacts 12 to 15 inclusive, are operated together between a right position for eastbound traffic and a left position for westbound traffic. They are shown occupying their right position for an established eastbound movement. It is to be noted that a single source connection and single receiver network are used alternately for sections 1T and 2T by movement of the contacts of device FR.

For a specific showing and to illustrate one principal use of the invention, the track circuits are assumed to be of the phase selective type. The track receiver apparatus is then a phase selective unit, shown conventionally by the dot-dashblock at the lower right labeled PSU, and an associated track relay TR, illustrated as being of a two winding type. Alternating current energy of the track circuit frequency, received through the rails from the other end of a section when it is unoccupied, is compared with the energy applied to unit PSU from the local connections to the track circuit source (BX, NX). When track or rail current is received and the proper relation exists with the local energy, relay TR is energized to indicate or register an unoccupied track condition. An example of a phase selective unit PSU is disclosed in U.S. Pat. No. 2,884,516, issued Apr. 28, 1959 to C. E. Staples, for a Phase Sensitive Alternating Current Track Circuit. This phase selective apparatus may be modified, if desired, by combining with the filter network disclosed in U.S. Pat. N. 3,986,691, issued Oct. 19, 1976 to A. G. Ehrlich et al, for Phase Selective Track Circuit Apparatus. Reference may be had to either of these prior patents for a complete understanding, if desired, of the operation of unit PSU. Protection against a high level harmonic from the propulsion current in the rails is provided for the track circuits at this location by the unit PRU illustrated within the dot-dash block immediately above unit PSU. The internal circuitry illustrated for unit PRU is identical with that shown in FIG. 1 and is repeated here for convenience in the following description.

As shown in FIG. 2, with eastbound traffic established, energy is supplied to the track circuit for section 1T from source terminals BX and NX at the left of the drawing through limiting resistor 16 and over right contacts 14 and 15 of device FR to the field winding of track transformer 10. Energy induced in the track winding of this transformer flows through rails 1 and 2 to the other or entrance end of section 1T. A similar network applies energy from terminals BX and NX to the rails 1 and 2 at the other or exit of section 2T. Usually the track transformer and rail connections are selected so that adjoining sections have opposing instantaneous polarity in the corresponding rails on each side of joints 3. With no train occupying section 2T, energy from the rails 1 and 2 of this section is passed through track transformer 11 and over right contacts 12 and 13 of device FR to the input of unit PRU and thus to winding P. The output of winding S1 is then applied to the track input terminals of unit PSU. If the relationship between the received track energy and that received from the local source connections is proper, unit PSU energizes relay TR sufficiently to pick up and register an unoccupied condition of section 2T.

The capacitor C connected across winding S2 resonates with the transformer primary winding P at the signaling frequency so that the entire transformer unit PRU appears as a parallel resonant (high impedance) load in multiple with unit PSU. The loss in input energy to unit PSU resulting from the insertion of unit PRU in its input leads is negligible so that the protection unit may be added to a track circuit without requiring an adjustment of the energy level supplied at the exit end of the corresponding section. For example, insertion of unit PRU will not require a change in the value of the limiting resistor such as 16 shown in the energy supply network for section 1T. With normal propulsion current levels, the track circuit functions as intended and registers the unoccupied or occupied condition of section 2T by the picked up or release position of relay Tr.

However, at the propulsion frequency, the impedance of transformer primary winding P is small and the capacitive reactance of capacitor C is large, so that their parallel combination gives the entire unit PRU a small input impedance. Normally little, if any, propulsion current flows through transformer 11 into winding P as long as the propulsion current is substantially balanced in rails 1 and 2. If a troublesome amount of propulsion frequency voltage appears at the input terminals of unit PRU, that is, across winding P, due to a severe unbalance in the track rail currents, then current large enough to blow the built-in fuse F is drawn by the low impedance of winding P. Actually, the capacity of fuse F is preselected to blow only at levels of propulsion interference high enough to contain sufficient energy of harmonic frequency near or at the signaling frequency to produce a potential beat condition in unit PSU. Smaller levels of propulsion current which are unlikely to cause this beat interference will be tolerated by fuse F in order to avoid nuisance interruptions of the track circuit operation. In other words, fuse F should interrupt the circuits through unit PRU and thus the supply of energy to unit PSU if the levels of the critical harmonic frequencies of the propulsion current are such as to be accepted by unit PSU as valid track circuit signals and possibly energize relay TR to register an unoccupied section even though a train is actually occupying section 2T. In the specific examples, with a propulsion frequency of 25 Hz, the critical harmonics will be the fourth and eighth harmonics as the track circuit frequency is 100 or 200 Hz, respectively. Although the opening of fuse F inhibits further operation of the track circuit apparatus for section 2T, this is a safe failure since an inadvertent and improper unoccupied track condition will not be registered.

The operation of unit PRU is vital because, if capacitor C shorts out, the unit appears as a short circuit in parallel with unit PSU and thus this latter unit cannot operate. If capacitor C opens, the impedance of unit PRU at the signaling frequency decreases. This should shunt sufficient energy away from unit PSU to cause relay TR to release. If, however, the track circuit receiver network is overenergized by propulsion current to the point of allowing unit PSU to continue operating, for example, because an impedance bond lead is broken, no safety is sacrificed since the unit retains its protective behavior at the propulsion frequency which does not depend on the presence of capacitor C.

The arrangement of the invention thus provides protection for alternating current track circuits from high energy level harmonics of the propulsion frequency which may simulate or match the track circuit frequency. This protection is accomplished with apparatus involving no moving parts or active solid state elements. Rather, a passive transformer unit with an associated fuse and capacitor are added to the track circuit network and do not require any additional energy from the track circuit source through the rails under normal operation. The operation of the protection apparatus is vital even though faults may occur in the capacitor element. The resulting apparatus is thus effective protection and economical to manufacture.

Although I have herein shown and described but one arrangement using the parallel resonant unit of the invention for protecting alternating track circuits from propulsion energy, it is to be understood that various changes and modifications in the illustrated apparatus may be made within the scope of the appended claims without departing from the spirit and scope of my invention.

Having thus described the invention, what I claim as new and desire to protect by Letters Patent, is:

1. A vital protection arrangement for alternating current track circuits in an electrified railroad with propulsion current return through the rails, each track circuit including a receiver at one end for registering the occupancy condition of the corresponding track section in accordance with the presence or absence of track current of selected characteristics, comprising, (a) a transformer having a primary, secondary, and third winding with said secondary winding coupled to said track circuit receiver, (b) a fuse having a preselected capacity coupled in series with said primary winding to the track section rails for receiving the current flowing in said rails, and (c) a capacitor connected across said third winding and having a selected value to resonate with said primary winding at the track circuit frequency, (d) said primary-capacitor resonant circuit network presenting a high parallel impedance at track circuit frequency, for passing track circuit current through said secondary winding to said receiver without exceeding the capacity of said fuse, and a low impedance at other frequencies, and (e) said fuse interrupting the circuit network to said receiver when propulsion current flowing in said primary winding exceeds the preselected capacity of said fuse.

2. A vital protection arrangement as defined in claim 1 in which, (a) the propulsion power is an alternating current having a frequency lower than said track circuit frequency, and (b) said track circuit frequency is substantially an even harmonic of said propulsion frequency so that said resonant circuit network accepts the harmonic components of a high level propulsion current as a valid track circuit signal unless the coupling of said primary winding to said rails is interrupted by said fuse.

3. An alternating current track circuit arrangement for a section of alternating current electrified railroad with propulsion current return through the section rails, the track circuit frequency being greater than and substantially an even harmonic of the propulsion power frequency, comprising, (a) a source of track circuit energy coupled to the rails at the exit end of said section, (b) a receiver unit coupled to said rails at the entrance end of said section and responsive to input energy of said track circuit frequency and selected level for registering an unoccupied section indication, (c) a parallel resonant unit, including a circuit interrupter with a preselected rating, coupled between said receiver unit and said rails and tuned to act as a parallel resonant high impedance circuit at said track circuit frequency, for providing track circuit frequency energy to said receiver unit from said rails, and (d) said parallel resonant unit acting as a low impedance at propulsion power frequency and responsive to levels of said propulsion current exceeding said preselected rating for interrupting the track current input to said receiver unit to inhibit registry of an unoccupied section indication.

4. A track circuit arrangement as defined in claim 3 in which said parallel resonant unit comprises, (a) a transformer having a first, second, and third winding with said second winding coupled to said receiver unit, (b) fuse with preselected rating coupled in series with said first winding for receiving current from said rails, (c) a capacitor connected across said third winding and having a value selected to resonate with said first winding for providing a high impedance parallel resonant circuit at the track circuit frequency so that said second winding supplies energy of that frequency to said receiver unit, and (d) said first winding presenting a low impedance to rail current at said propulsion frequency for drawing a current exceeding said fuse rating, when the propulsion current and its harmonics have a high level, to interrupt the supply of energy to said second winding and said receiver unit.

5. A track circuit arrangement as defined in claim 4 in which, said receiver unit is also coupled to said track circuit source for receiving a second energy input to establish operating parameters for the receiver unit when energy of said track circuit frequency is also received from said rails through said second winding.

6. In combination with a track circuit receiver of an alternating current track circuit for a section of electrified railroad, parallel resonant transformer apparatus comprising, (a) a primary winding, (b) a fuse of preselected capacity coupled in series with said primary winding across the section rails for receiving energy when the section is unoccupied, (c) a secondary winding coupled for supplying energy to the track circuit receiver when said primary winding is energized from said rails, (d) a third winding, and (e) a capacitor coupled across said third winding and having a value selected for resonating with said primary winding at the track circuit frequency to provide a high impedance parallel resonant circuit network which maintains current flow through said primary winding below said fuse capacity, (f) said primary winding having a low impedance at other frequencies whereby flow of propulsion current exceeding said fuse capacity interrupts the supply of energy from said rails to said track circuit receiver.

* * * * *

UNITED STATES PATENT AND TRADEMARK OFFICE

CERTIFICATE OF CORRECTION

PATENT NO. : 4,392,626

DATED : July 12, 1983

INVENTOR(S) : Robert D. Pascoe

It is certified that error appears in the above-identified patent and that said Letters Patent are hereby corrected as shown below:

Column 6, line 66, before "fuse" insert --a--

Column 8, line 6, after "receiving" insert --track circuit--

Signed and Sealed this

*Twenty-seventh* Day of *September 1983*

[SEAL]

*Attest:*

GERALD J. MOSSINGHOFF

*Attesting Officer*

*Commissioner of Patents and Trademarks*